United States Patent [19]

Renger et al.

[11] Patent Number: 4,738,647

[45] Date of Patent: Apr. 19, 1988

[54] ACTIVITY TOY FOR FORMING AND DISSOLVING A FIGURE TOY

[75] Inventors: Larry H. Renger, Hawaiian Gardens; Dennis C. Rich, Long Beach; Wallace H. Shapero, Canoga Park, all of Calif.

[73] Assignee: Mattel, Inc., Hawthorne, Calif.

[21] Appl. No.: 948,371

[22] Filed: Dec. 31, 1986

[51] Int. Cl.[4] ..... A63H 3/16; A63H 33/00

[52] U.S. Cl. ..... 446/86; 446/268; 446/375; 446/385; 446/491

[58] Field of Search ..... 446/268, 385, 491, 373, 446/375, 374, 97, 85, 86

[56] References Cited

U.S. PATENT DOCUMENTS

| | | | |
|---|---|---|---|
| 1,566,801 | 12/1925 | Millard | 446/99 |
| 1,579,367 | 4/1926 | Hymer | 446/376 |
| 1,601,447 | 9/1926 | Huck | 446/375 |
| 1,620,069 | 3/1927 | Bucherer | 446/375 |
| 2,662,335 | 12/1953 | Calverley | 446/99 |
| 2,752,726 | 7/1956 | Calverley | 446/99 |
| 3,456,045 | 7/1969 | Rosen | 446/385 X |
| 3,783,554 | 1/1974 | Shapero | 446/385 X |
| 4,103,451 | 8/1978 | Kawada et al. | 446/99 |
| 4,274,224 | 6/1981 | Pugh et al. | 446/383 X |
| 4,518,367 | 5/1985 | Zaruba et al. | 446/373 |

*Primary Examiner*—Mickey Yu

*Attorney, Agent, or Firm*—Ronald M. Goldman; Melvin A. Klein; Daniel F. Sullivan

[57] ABSTRACT

An activity toy which may be used to first form a toy monster figure by shaping a plastic molding material mixed with sodium bicarbonate powder around a toy skeleton, and to then dissolve or break the molding material free from the toy skeleton by immersing the monster figure in a diluted citric acid solution contained in a vat. The toy skeleton is made out of a number of parts removably held together by ball-and-socket joints. Measuring receptacles are provided for determining the amount of plastic molding material needed for forming the toy monster figure. Stamps may be used to form the face or other part of the toy monster figure, or to add texture or detail to the molding material.

11 Claims, 4 Drawing Sheets

ACTIVITY TOY FOR FORMING AND DISSOLVING A FIGURE TOY

BACKGROUND OF THE INVENTION

This invention relates generally to activity toys and, more particularly, to an activity toy which may be used to first form a toy monster figure by shaping a plastic molding material mixed with sodium bicarbonate powder around a toy skeleton, and to then dissolve or break apart the molding material by immersing the monster figure in a diluted citric acid solution contained in a vat.

In the past, a variety of articulated or jointed figure toys or dolls have been fabricated such as those disclosed in U.S. Pat. Nos. 4,274,224; 4,103,451; 2,752,726; 2,662,335; 1,620,069; 1,601,447; 1,579,367; and 1,566,801. U.S. Pat. No. 3,456,045 describes a method of manufacturing foamed doll bodies which includes tearing portions of gasketing material from the finished doll bodies. Finally, U.S. Pat. No. 4,518,367 discloses an activity toy which uses a clear mask to mold a plastic substance in order to form the face of a figure.

None of the above patents discloses an activity toy which may be used to first form a toy monster figure out of a plastic molding material mixed with sodium bicarbonate powder by shaping the material around a toy skeleton, and to then dissolve or break apart the molding material by immersing the monster figure in a diluted citric acid solution contained in a vat. A particularly dramatic effect is presented as the molding material dissolves revealing the underlying skeleton. The skeleton may then be reused by forming another monster figure with additional molding material. Accessories may be used to form the face or some other portion of the toy monster figure or to add texture to the molding material in order to provide a more realistic looking monster figure. Alternatively, a child may strip molding material from the skeleton by hand rather than dissolving it in the diluted citric acid solution. Accordingly there is a need in the toy manufacturing arts for the aforementioned activity toy.

SUMMARY OF THE INVENTION

It is an object of this invention to provide an activity toy which may be used to first form a toy monster figure by shaping a plastic molding material mixed with sodium bicarbonate powder around a toy skeleton, and to then dissolve or tear apart the molding material by immersing the monster figure in a diluted citric acid solution contained in a vat.

It is another object of this invention to provide accessories for the aforementioned activity toy which may be used to form the face or some other portion of the formed toy monster figure or to add texture or detail to the molding material in order to provide a more dramatic or realistic looking monster figure.

It is still another object of this invention to provide a toy skeleton for the aforementioned activity toy which may be assembled into a variety of different configurations.

It is still another object of this invention to provide a means for measuring the amount of molding material needed to form one toy monster figure.

It is still another object of this invention to provide a method of forming and dissolving a toy monster figure.

These and other objects and advantages are attained by an activity toy which may be used to first form a toy monster figure by shaping a plastic molding material mixed with sodium bicarbonate powder around a toy skeleton, and to then dissolve or break the molding material free from the toy skeleton by immersing the monster figure in a diluted citric acid solution contained in a vat. The toy skeleton is made out of a number of parts removably held together by ball-and-socket joints. Measuring receptacles are provided for determining the amount of plastic molding material needed for forming the toy monster figure. Stamps may be used to form the face or other part of the toy monster figure, or to add texture or detail to the molding material.

The various features of the present invention will be best understood together with further objects and advantages by reference to the following description of the preferred embodiment taken in connection with the accompanying drawings.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a commercial environment, although it should be understood that various modifications can be accomplished within the parameters of the present invention.

Figure 1:
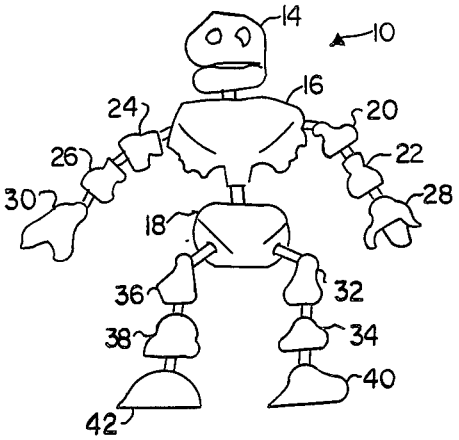
FIG. 1 is a front elevational view of a toy skeleton used for the activity toy of the present invention.
Figure 2:
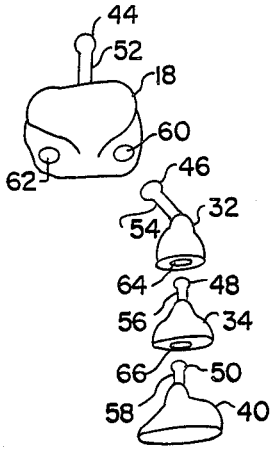
FIG. 2 is an enlarged, exploded perspective view showing typical ball-and-socket joints used for the toy skeleton.

Referring now to the drawings and particularly to FIGS. 1 and 2, a toy skeleton 10 used with the activity toy 12 of the present invention is shown. The skeleton 10 may have any configuration and is formed by a plurality of parts held together by ball-and-socket joints as shown in FIG. 2. For example, head 14, upper torso 16, lower torso 18, arm 20 through 26, hand 28 and 30, leg 32 through 38 and foot 40 and 42 parts are used to form the skeleton 10 shown in FIG. 1. It is important to note that any number of parts may be used to form a toy skeleton 10. As such, the configuration of the skeleton 10 may be varied as desired. Also, the skeleton parts are preferably made out of a durable material such as plastic, or the like.

Typical skeleton parts 18, 32, 34 and 40 are shown in FIG. 2 in order to illustrate how the parts may be releasably coupled together by ball-and-socket joints. Stems 52 through 58 extending from the skeleton parts have ball portions 44 through 50, respectively, attached thereto. As shown, parts 18, 32 and 34 have openings or sockets 60 through 66 therein. The ball portions and sockets are fabricated so that a child may easily push the ball portions into the sockets coupling the skeleton parts together. The ball portions may then be pulled out of the sockets if desired uncoupling the parts. As such, the ball-and-socket joints may be used to releasably couple the skeleton parts together. In addition, the ball portions and sockets are preferably identical in size so that a child may push any ball portion into any socket. For example, ball portion 50 may be pushed into any one of sockets 60 through 66. However, the ball portions and sockets may vary in size if desired.

Figure 3:
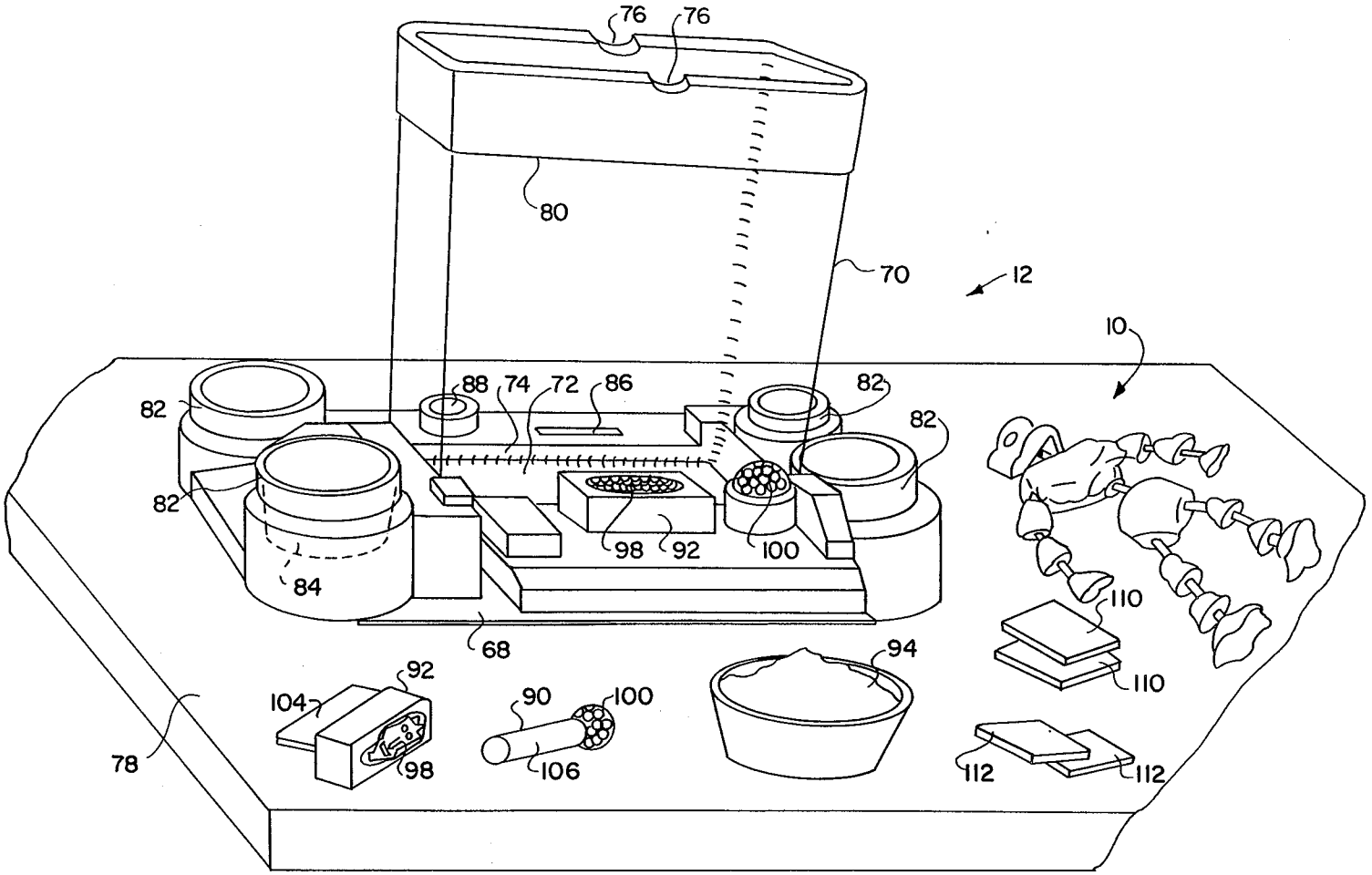
FIG. 3 is a perspective view of the toy skeleton and of a vat, base support, stamps, container of molding material and packages of sodium bacarbonate powder and citric acid powder used for the activity toy.

The preferred embodiment of the activity toy 12 of the present invention is shown in FIG. 3. A base support 68 is used to hold a hollow, generally box-shaped vat 70 having a flat bottom 72, four sides extending upwardly from the bottom and an open upper end. The vat 70 removably fits into an opening 74 at the top of the base support 68 and is preferably made out of a transparent plastic material so that an object placed inside it may be viewed as explained below. The vat 70 has apertures 76 at the upper edges of its open end as shown in FIG. 3. When the base support 68 is placed on a flat surface 78 and the vat 70 is fit into opening 72 as shown in FIG. 3, the vat 70 will extend vertically upward from the support. As such, the vat 70 may be used as a container for holding a liquid solution. Line 80 may be used as a measuring line for the liquid solution as explained below.

The base support 68 may have any external appearance that will appeal to the creative imagination of children. Measuring receptacles 82 are provided at the top of the base support 68 for the reasons explained below. Each measuring receptacle 82 provides a volume or cavity 84 represented by dashed lines in FIG. 3. The measuring receptacles 82 shown in FIG. 3 are formed by upwardly extending cylinders. However, the receptacles 82 may be formed by any structure which provides the required cavity size 84. Slots 86 and apertures 88 are also provided at the top of the base support 68 for stamps 90 and 92 as explained below.

Figure 4:
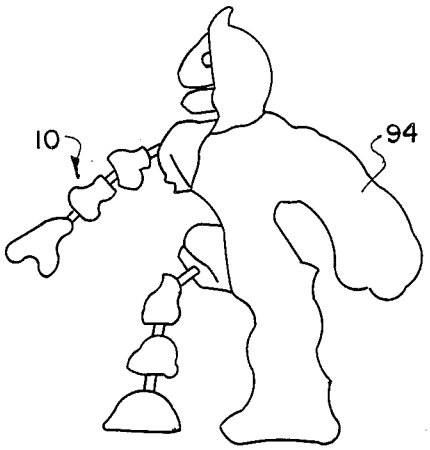
FIG. 4 is a front elevational view showing how molding material may be shaped around the toy skeleton.
Figure 5:
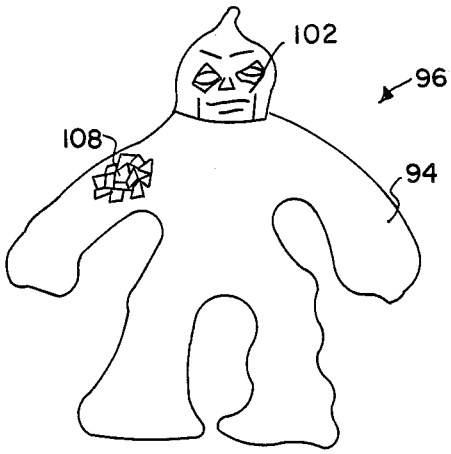
FIG. 5 is a front elevational view of a toy monster figure formed by shaping molding material around the toy skeleton.

A container of plastic molding material 94 is provided with the activity toy 12. Any type of plastic molding material 94 may be used which is malleable and is capable of dissolving or breaking apart when mixed with sodium bicarbonate powder and immersed in a diluted citric acid solution as explained below. After the toy skeleton 10 is formed by coupling any number of skeleton parts together using the ball-and-socket joints, a child may use the plastic molding material 94 to form a toy monster FIG. 96 (see FIG. 5) by shaping the material around the toy skeleton 10 as shown in FIG. 4. The toy monster FIG. 96 may have any shape or configuration. The configuration shown in FIG. 5 is presented as only one example and may be varied by adding or deleting plastic molding material 94, or by changing the skeleton parts. Also, a child may strip the plastic molding material 94 off the toy skeleton 10 and start over if desired.

Stamps 92 shown in FIG. 3 may be used to form the face or some other part of the toy monster FIG. 96 by simply pressing portion 98 against the plastic molding material 94. Portions 98 may contain projecting details, depressions, reliefed surfaces, any type of coarse, textured, or smooth surface, or any face, arm, leg, body or other shape. for example, one of stamps 92 may be used to form the face 102 of the toy monster FIG. 96 shown in FIG. 5. Preferably, each stamp 92 has an extension 104 which fits into one of slots 86 at the top of the base support 68 providing a convenient means of storing loose parts. The shape of extensions 104 can vary and any type of apertures may be used instead of slots 86 for engaging extensions 104. Similarly, stamps 90 have extensions 106 which fit into apertures 88. Curved portions 100 of stamps 90 may also be used to shape, form or add texture to the plastic molding material 94. Portions 100 may contain projecting details, depressions, reliefed surfaces, or any type of course, textured or smooth surface. For example, one of stamps 90 may be used to shape the plastic molding material 94 of the toy monster figure shown in FIG. 5 so that the skin of the figure appears to have scales 108 presenting a more dramatic or realistic looking monster figure.

The volume 84 of each measuring receptacle 82 is established so that a child may measure the approximate amount of plastic molding material 94 needed to cover one toy skeleton 10. In addition, the amount of plastic molding material 94 needed to fill one receptacle 82 also determines approximately how much material should be mixed with one package 110 (each package preferably contains 3 grams) of sodium bicarbonate powder before shaping the molding material around the toy skeleton 10. As explained later, if the plastic molding material 94 is mixed with sodium bicarbonate material, it will dissolve or fall apart when immersed in a diluted citric acid solution. Other types of alkaline salts or soda may be used instead of the sodium bicarbonate powder if desired.

The activity toy 12 may by used by a child as follows. The child first assembles the toy skeleton 10 by fitting skeleton parts together using the ball-and-socket joints. The amount of plastic molding material 94 needed to cover the skeleton 10 is determined by filling cavity 84 of one of the receptacles 82. The measured amount of molding material 94 is then mixed with one package 110 of sodium bicarbonate powder. Next, the plastic molding material 94 is shaped around the toy skeleton 10 forming the toy monster FIG. 96. Stamps 90 and 92 may then be used to shape the molding material 94 adding increased texture or detail to the toy monster figure. After the monster FIG. 96 is formed, it may be dissolved or broken apart in the vat 70 as explained below.

Figure 6:
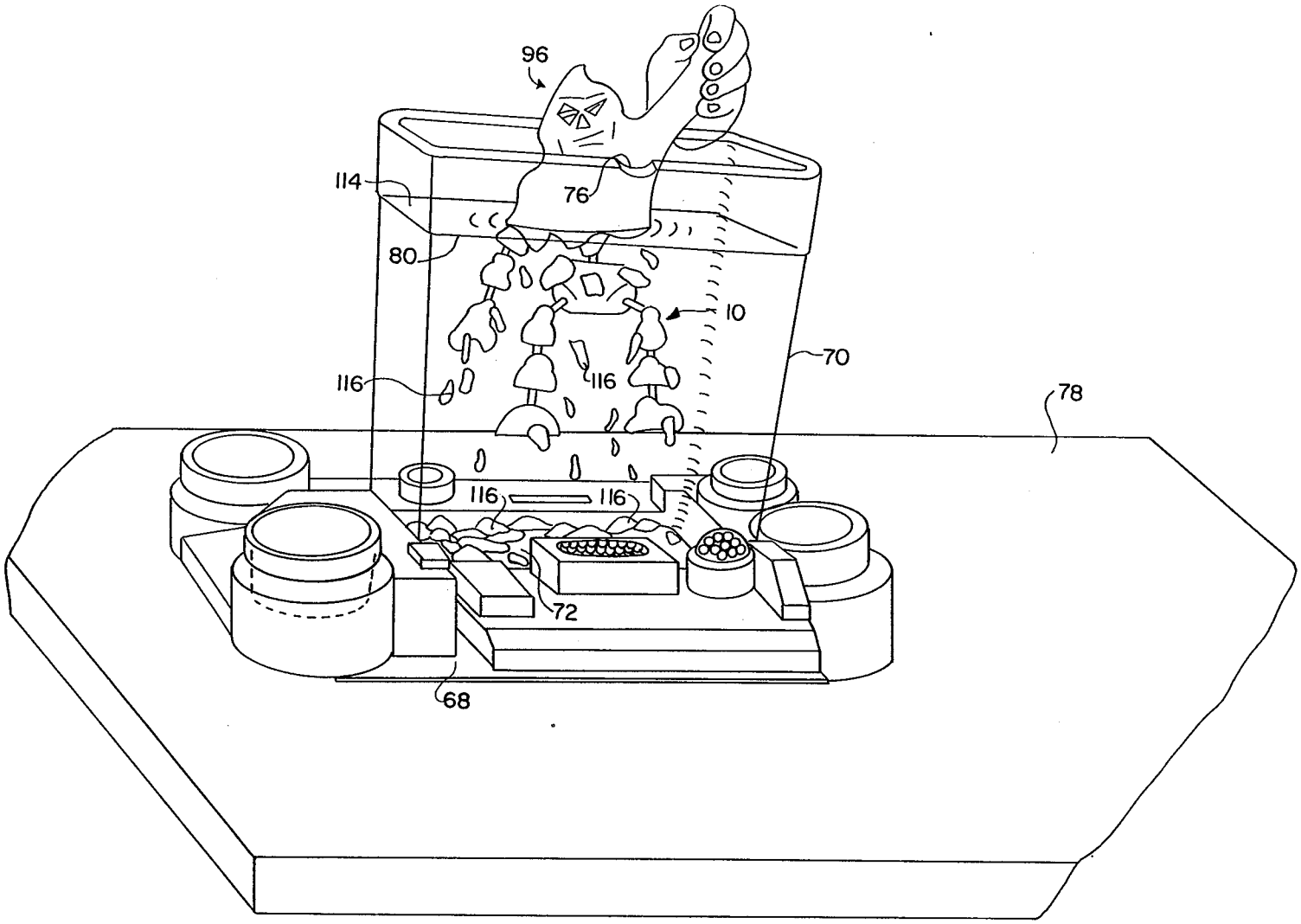
FIG. 6 is a perspective view showing how the toy monster figure may be dissolved or pulled apart in the vat when immersed in a diluted citric acid solution.

Packages 112 of citric acid powder are provided with the activity toy 12. The citric acid powder may be mixed with water in the vat 70 to form a diluted citric acid solution as follows. First, the vat 70 is filled with water until the upper water level 114 reaches measuring line 80 (preferably 600 millileters of water is used). Then, the amount of citric acid powder contained in one package 112 (preferably 3 grams) is added to the water. Lemon or lime juice, vinegar, or another type of acid may be added to the water instead of citric acid powder if desired. After the vat 70 is filled with the diluted citric acid solution, a child may immerse the toy monster FIG. 96 in the solution as shown in FIG. 6. This will cause the sodium bicarbonate powder mixed with the plastic molding material 94 to react with the diluted citric acid solution. Due to the reaction, the molding material 94 dissolves in the solution or pieces 116 of the material break free from the toy skeleton 10 falling to the bottom 72 of the vat 70. This presents a particularly dramatic effect as the skin of the toy monster FIG. 96 appears to dissolve or boil-away during the foaming reaction in the vat 70 leaving the bare toy skeleton 10 behind, all of which can be viewed through the transparent vat. A rod or other member (not shown) may be placed into apertures 76 at the upper edges of the vat 70 and used to support the toy monster FIG. 96 using a string or other means (not shown) during the reaction in the vat 70.

The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention.

We claim:

1. An activity toy comprising:

a base support having an opening at the top thereof:

a generally box-shaped vat, said vat removably fitting into said opening in said base support;

a plurality of parts capable of being releasably coupled together in order to form a figure configuration;

a plastic material capable of being shaped around said configuration;

a salt capable of being mixed with said plastic material; and an acid capable of being mixed with said water in said vat in order to provide a diluted solution, said plastic material when mixed with said salt and shaped around said figure configuration capable of breaking loose from said configuration after being immersed in said diluted solution.

2. The activity toy of claim 1 wherein said salt is sodium bicarbonate powder and said acid is citric acid powder.

3. The activity toy of claim 1 wherein said base support has at least one measuring receptacle means for determining the amount of plastic material needed to cover said figure configuration.

4. The activity toy of claim 3 further comprising stamp means for shaping said plastic material.

5. An activity toy comprising:

a base support having an opening and at least one measuring receptacle at the top thereof;

a generally box-shaped vat having a bottom, four sides extending upwardly from said bottom and an open end at the top thereof, said vat removable engaging said opening in said base support;

a plurality of parts capable of being releasably coupled together by ball-and-socket joints in order to form a configuration resembling a skeleton;

a plastic material capable of being shaped around said configuration;

sodium bicarbonate powder capable of being mixed with said plastic material; and citric acid powder capable of being mixed with water in said vat in order to provide a diluted solution, said plastic material when mixed with said sodium bicarbonate powder and shaped around said configuration capable of breaking loose from said configuration after being immersed in said diluted solution.

6. The activity toy of claim 5 further comprising stamp means for shaping said plastic material.

7. The activity toy of claim 6 wherein the amount of said sodium bicarbonate powder used is about 3 grams, the amount of said citric acid powder used is about 3 grams and the volume of water used for said diluted solution is about 600 millileters.

8. A method of forming and dissolving a toy figure comprising the steps of:

coupling together a plurality of parts in order to provide a figure configuration;

mixing a salt with a plastic material;

shaping said mixture of salt and plastic material around said figure configuration in order to form a toy figure;

mixing an acid with water in a vat to provide a diluted solution; and immersing said toy figure in said diluted solution so that said salt reacts with said diluted solution in order to cause said plastic material to break loose from said figure configuration.

9. The method of claim 8 wherein said plurality of parts are releasably held together by ball-and-socket joints.

10. The method of claim 8 further comprising the step of measuring an amount of plastic material needed to cover said figure configuration before mixing said salt with said plastic material.

11. The method of claim 8 wherein said shaping step includes pressing at least one stamp against said mixture of salt and plastic material in order to add texture and detail to said toy figure.

* * * * *